US006396379B1

(12) United States Patent
Kondo et al.

(10) Patent No.: US 6,396,379 B1
(45) Date of Patent: May 28, 2002

(54) COIL DEVICE

(75) Inventors: Masami Kondo; Takahisa Suda; Hajime Muramatsu, all of Saitama (JP)

(73) Assignee: Bosch Automotive Systems Corporation, Tokyo (JP)

( * ) Notice: Subject to any disclaimer, the term of this patent is extended or adjusted under 35 U.S.C. 154(b) by 0 days.

(21) Appl. No.: 09/744,208

(22) PCT Filed: Sep. 24, 1999

(86) PCT No.: PCT/JP99/05232

§ 371 (c)(1),
(2), (4) Date: Mar. 13, 2001

(87) PCT Pub. No.: WO00/21100

PCT Pub. Date: Apr. 13, 2000

(30) Foreign Application Priority Data

Oct. 2, 1998 (JP) ..... 10-281201

(51) Int. Cl.[7] ..... H01F 27/28; H01F 27/30
(52) U.S. Cl. ..... 336/208; 336/189; 336/198
(58) Field of Search ..... 336/192, 198, 336/187, 208, 209

(56) References Cited

U.S. PATENT DOCUMENTS 4,274,136 A * 6/1981 Onodera et al. ..... 363/68
4,477,967 A * 10/1984 Yabuoshi et al. ..... 29/596
4,808,959 A * 2/1989 Weissman ..... 336/189
5,331,298 A * 7/1994 Kameya ..... 333/138
5,567,999 A * 10/1996 Baronosky et al. ..... 310/194
5,939,955 A * 8/1999 Chen et al. ..... 333/185

* cited by examiner

*Primary Examiner*—Anh Mai
(74) *Attorney, Agent, or Firm*—Kanesaka & Takeuchi

(57) ABSTRACT

In a coil device (1) which has a plurality of winding drums (6) on a bobbin (2) with a partition (5) formed between flanges (3), (4) at both ends of the bobbin, the partition (5) has a slit (7) through which a wire (w) is passed, and among winding pitches of the wire wound on adjacent winding drums (6) with the partition (5) therebetween, at least a pitch (P1) between a segment of the wire passing through the slit and its adjacent segment of the wire is larger than a pitch (P2) between the segments of the wire at other portions. The positions of the slit (7) of the partition (5) and a slit (8) of the flange (3) are displaced by a predetermined angle with respect to the center of the winding so to angle the wire passing through both slits with respect to the center of the winding. And, the coil system (1) has a one-side radiused portion (7*b*) formed at the slit end with which the wire passing through the slit (7) of the partition (5) is slidably contact.

1 Claim, 6 Drawing Sheets

COIL DEVICE

TECHNICAL FIELD

The present invention relates to a coil device which is provided with a plurality of winding drums on a bobbin with a partition formed between flanges at both ends of the bobbin.

BACKGROUND ART

A coil device which is formed by winding a coil around a bobbin is often used to generate a magnetic force (e.g., a solenoid, a magneto coil or the like) or to detect a magnetic flux (e.g., a detector for detecting the number of revolutions of a distributor type pump or the like).

As shown in FIG. 6, generally, a coil device 1 of the type described above has a partition 5 formed between flanges 3, 4 at both ends of a bobbin 2 to provide a plurality of winding drums 6, 6 on the bobbin 2. The shape of bobbin of the coil device 1 is often determined depending on output characteristics or limitations in the system. Especially, it is known that when a thickness t of the partition 5 is increased, the coil has a long overall length, and it becomes difficult to make it compact. It is also known that the output sensitivity in the output characteristics is lowered. Therefore, the thickness t of the partition 5 cannot be made large.

In the coil device 1 having the plurality of winding drums 6, 6 on the bobbin 2 of the above-described prior art, a slit 7 is formed in the partition 5. A wire w is arranged from one of the winding drums 6, 6 to the other through the slit 7. In FIG. 6, reference numeral 8 denotes a slit of the flange 3, reference numeral 9 denotes a terminal mount, and reference numerals 9*a*, 9*b*, 9*c* denote terminals.

As described above, the partition 5 of the small coil device 1 has a thickness t of about 1 mm because the thickness t of the partition 5 can not be made thick. When the partition 5 has the thickness of about 1 mm, a corner 7*a* of the slit 7 has a radius of about 0.5 mm. When an ordinary wire w having a diameter of 0.09 mm is passed around the corner 7*a*, the wire w has a bending diameter of (5× a wire diameter) at the corner 8*a*. Thus, the wire is bent acutely to concentrate a stress on the bent portion, possibly resulting in a breakage of the wire.

The present invention was achieved in view of the aforesaid situation. Thus, the present invention is to provide a coil device which can make the wire bend in the slit of the partition as small as possible to prevent the wire from being broken and to have an improved reliability, without making the bobbin in any special structure.

DISCLOSURE OF THE INVENTION

The invention recited in claim 1 is a coil device which has a plurality of winding drums on a bobbin with a partition formed between flanges at both ends of the bobbin, wherein the partition has a slit through which a wire is passed, and of winding pitches of the wire wound on adjacent winding drums with the partition therebetween, at least a pitch between a segment of the wire passing through the slit and its adjacent segment of the wire is larger than a pitch between the segments of the wire at other portions.

Thus, when the pitch between the wire segment passing through the slit and its neighboring wire segment is larger than the pitch between other wire segments, the wire segment passing through the slit of the partition has a large angle with respect to the partition. As a result, the wire can be prevented from being bent acutely at the corner of the slit and becomes free from a stress, so that its breakage can be prevented and the reliability can be improved.

The invention is a coil device which has a plurality of winding drums on a bobbin with a partition formed between flanges at both ends of the bobbin, wherein the partition has a slit through which a wire is passed, and the slit and a slit of each flange are displaced from each other by a predetermined angle with respect to the center of a winding so that the segments of the wire passing through the slits are angled with respect to the center of the winding.

Thus, when the positions of the slit and that of the flange are displaced by the predetermined angle with respect to the center of the winding to angle the wire segments passing through both slits with respect to the center of the winding, so that the wire segment passing through the slit of the partition has a large angle with respect to the partition in the same way as in claim 1. Therefore, the wire can be prevented from being bent acutely at the corner of the slit and free from a stress. Accordingly, the wire can be prevented from being broken and the reliability can be improved. Here, the predetermined angle depends on a length of the bobbin and particularly on an interval between the slits. Preferably, it is about 90 degrees for the compact coil device.

The invention is a coil device which has a plurality of winding drums on a bobbin with a partition formed between flanges at both ends of the bobbin, wherein the partition has a slit through which a wire is passed through, and a one-side radiused portion is formed at an end of the slit with which the wire passing through the slit is slidably in contact.

Thus, when the one-side radiused portion is formed at the slit end, the radiused portion can be made to have a considerably large curvature as compared with the formation of a both-side radiused portion at the slit end, so that the wire can be prevented from being bent acutely at the slit corner and becomes free from a stress. Therefore, the wire can be prevented from being broken and the reliability can be improved.

BEST MODES FOR CARRYING OUT THE INVENTION

Figure 1:
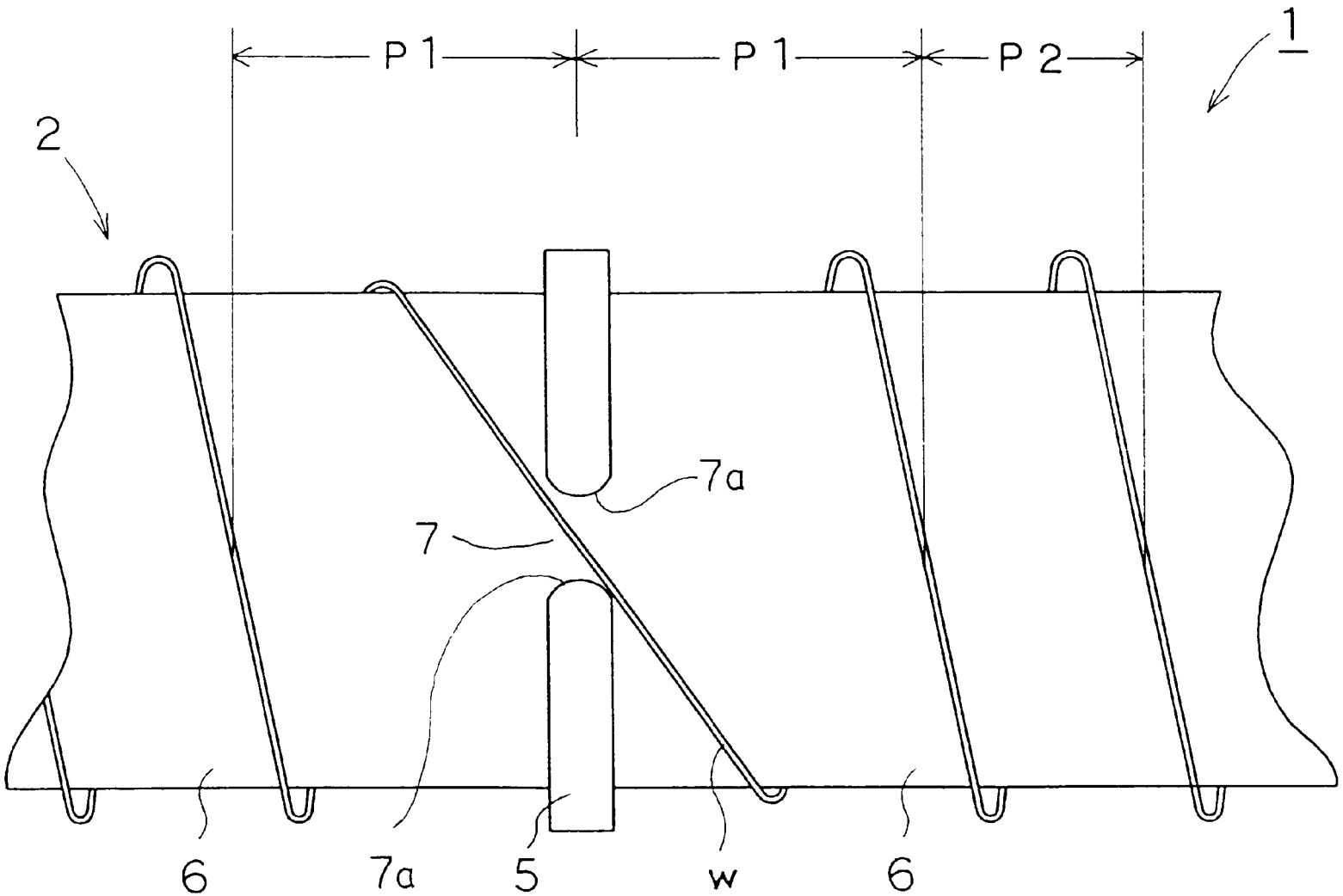
FIG. 1 is a diagram showing a coil device which has two winding drums on a bobbin with a partition therebetween according to an embodiment of the present invention.

Embodiments of the invention will be described in detail with reference to the accompanying drawings. It is to be noted that like reference numerals are used for like components as those of the prior art.

FIG. 1 shows a first embodiment of the invention in which a coil device 1 has a partition 5 formed between unillustrated flanges at both ends of a bobbin 2 to have two winding drums 6, 6 on the bobbin 2, and the partition has a slit 7 through which the wire w is passed. Thus, the coil device is configured in the same way as in the prior art.

In the coil device 1 of this embodiment, among the pitches of the segments of the wire wound around the neighboring winding drums 6, 6 with the partition 5 therebetween, a segment of the wire passing through the slit 7 and an adjacent segment of the wire have at least a pitch P1 which is larger than a pitch P2 between the other adjacent wire segments. Specifically, it is (P1>P2).

In this embodiment, when the pitch P1 between the segment of the wire passing through the slit 7 and the segment of the adjacent wire is determined to be larger than the pitch P2 between the other adjacent wire segments, the wire w passing through the slit 7 of the partition 5 has a large angle with respect to the partition 5. Therefore, the wire w can be prevented from being bent acutely at a corner 7*a* of the slit 7, becomes free from a stress and, as a result, its reliability can be improved.

Figure 2:
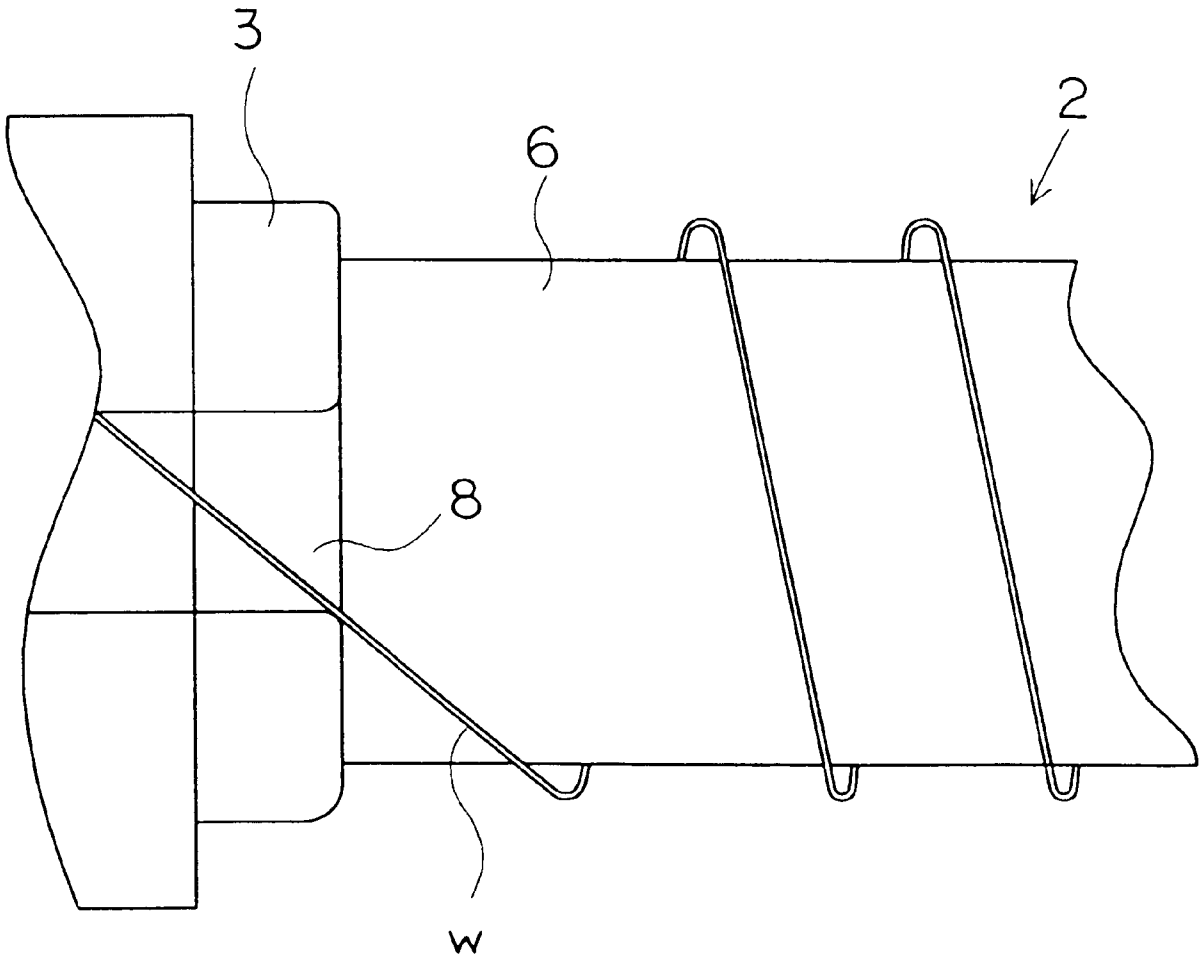
FIG. 2 is a diagram showing a winding drum and a flange according to an embodiment of the present invention.

As shown in FIG. 2, the pitch of the wire w passing through a slit 8 of the flange 3 may be made larger than the pitch of the segments of the wire at other portions, so that the angle of the wire w to the flange 3 becomes large. In the same way as described above, the wire w can be prevented from being bent acutely in the slit 8 of the flange 3, becomes free from a stress and prevented from being broken. Thus, its reliability can be improved.

Figure 3:
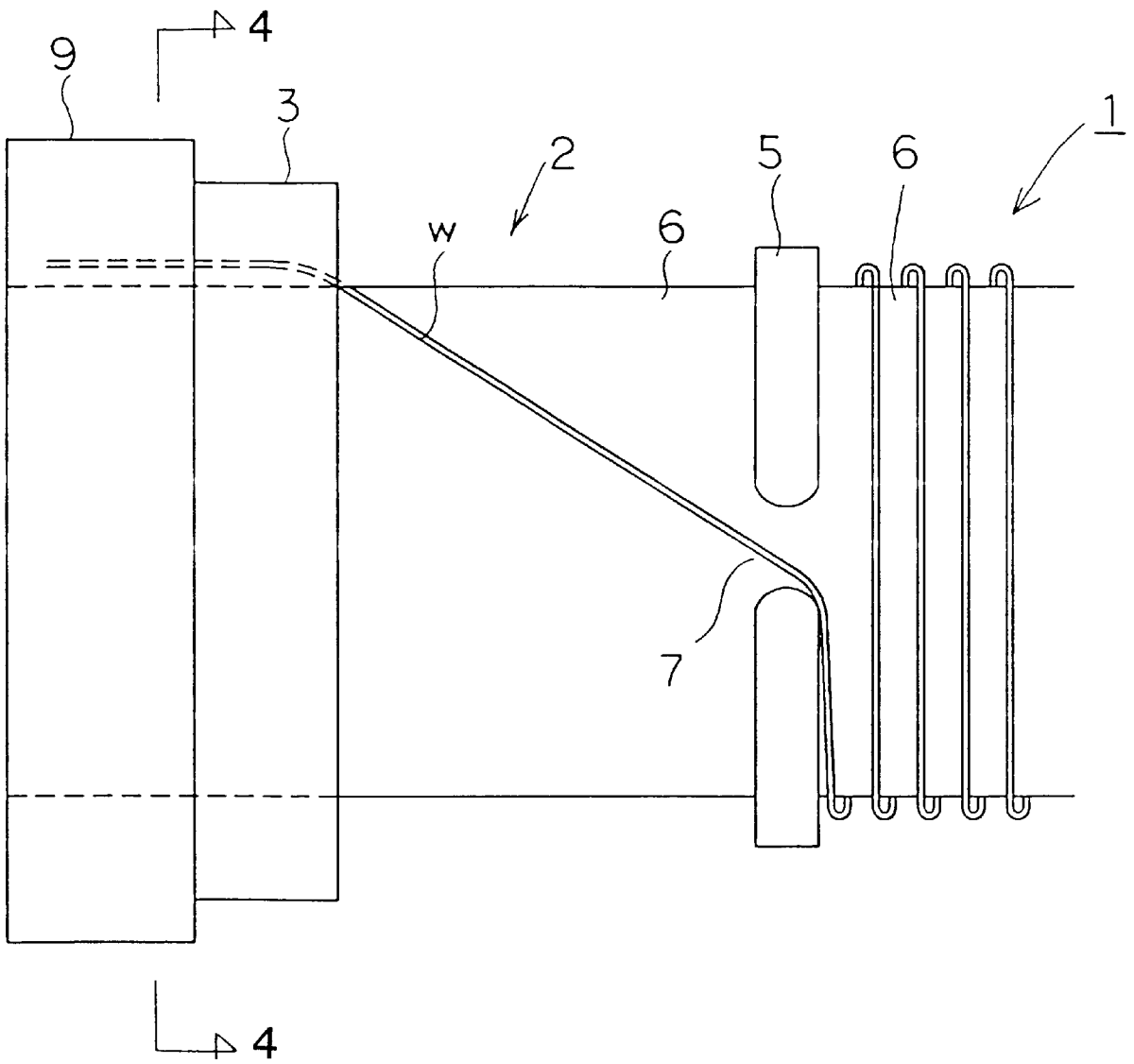
FIG. 3 is a diagram showing a coil device which has two winding drums on a bobbin with a partition therebetween according to another embodiment of the present invention.
Figure 4:
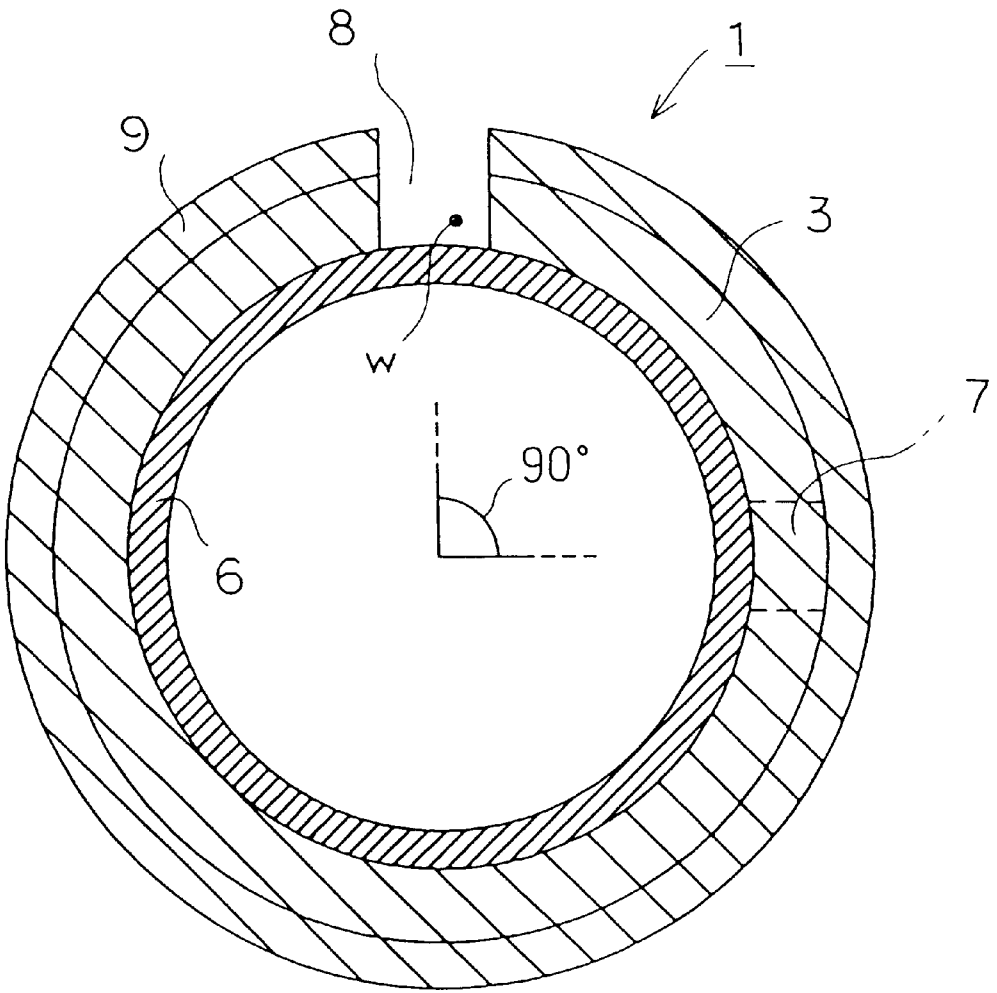
FIG. 4 is a sectional view taken along line X—X of FIG. 3.

FIG. 3 and FIG. 4 show a second embodiment in which the coil device 1 has the partition 5 formed between the flanges at both ends of the bobbin to have two winding drums 6, 6 on the bobbin 2, and the partition 5 has the slit 7 through which the wire w is passed in the same way as in the aforesaid embodiment.

In the coil device 1 of this embodiment, the slit 7 and the slit 8 of the flange 3 are displaced by a predetermined angle with respect to the center of the winding from each other, so that the segments of the wire passing through the slits 7, 8 are angled with respect to the center of the winding. In this embodiment, the positions of the slit 7 and the slit 8 of the flange 3 are displaced by 90 degrees with respect to the center of the winding as shown in FIG. 4.

In this embodiment, when the positions of the slit 7 of the partition 5 and the slit 8 of the flange 3 are displaced by the predetermined angle with respect to the center of the winding to angle the wire w passing through both of the slits 7, 8 with respect to the center of the winding, the wire w passing through the slit 7 of the partition 5 has a large angle with respect to the partition 5 in the same way as in the aforesaid embodiment. Therefore, the wire can be prevented from being bent acutely at the corner of the slit and becomes free from a stress. Accordingly, the wire can be prevented from being broken and the reliability can be improved.

Figure 5:
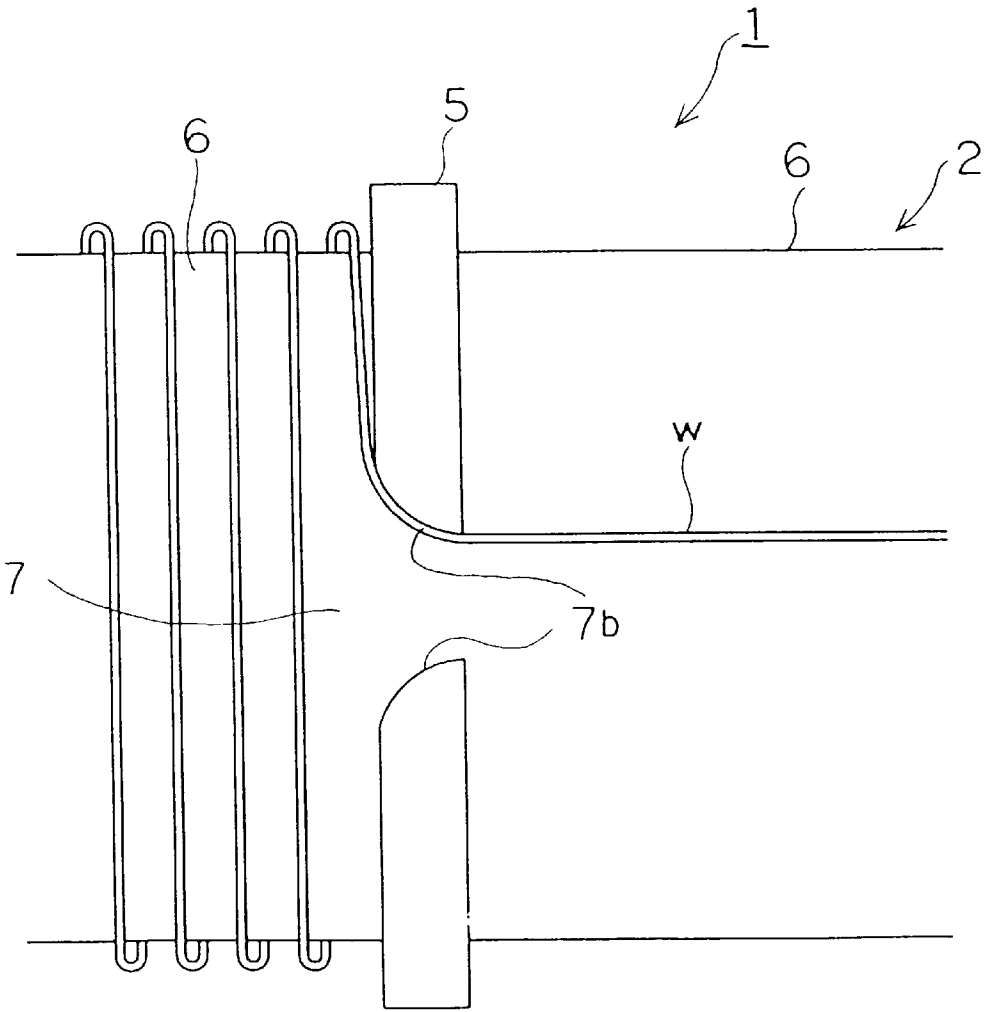
FIG. 5 is a diagram showing a coil device which has two winding drums on a bobbin with a partition therebetween according to another embodiment of the present invention.
Figure 6:
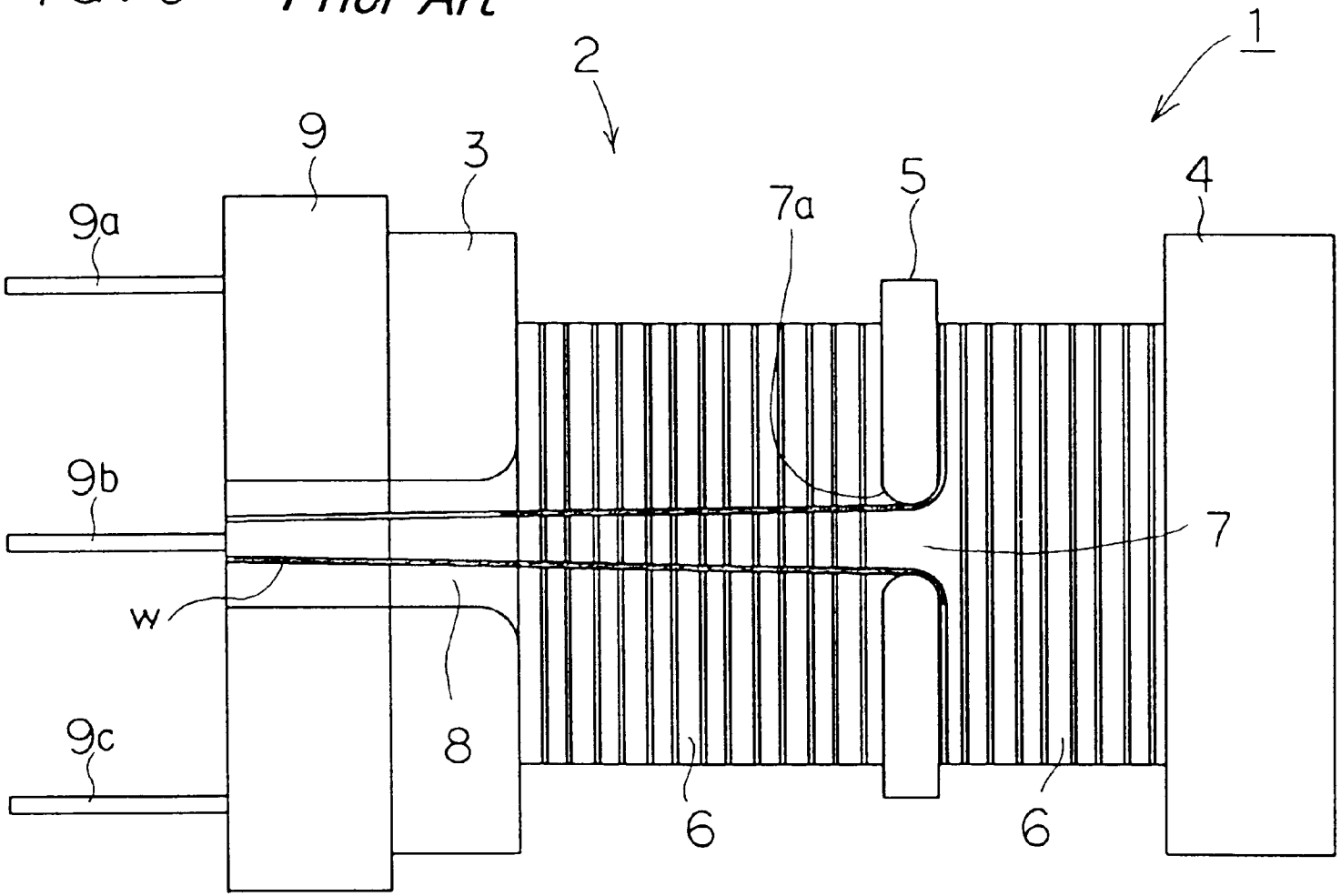
FIG. 6 Prior Art
FIG. 6 is a diagram showing a coil device which has two winding drums on a bobbin with a partition therebetween according to a prior art.

FIG. 5 shows a third embodiment in which the coil device 1 has the partition 5 formed between the flanges at both ends of the bobbin in the same way as in the aforesaid embodiment to have two winding drums 6, 6 on the bobbin 2, and the partition 5 has the slit 7 for passing the wire w therethrough.

In the coil device 1 of the embodiment, a one-side radiused portion 7*b* is formed at each end of the slit 7 of the partition 5 with which the wire passing through the slit 7 is slidably in contact.

In this embodiment, when the one-side radiused portion 7*b* is formed at the ends of the slit 7, the curvature of the radiused portion can be made considerably large as compared with the formation of a both-side radiused portion (the aforesaid corner 7*a*) at the slit end, so that the wire can be prevented from being bent acutely at the slit corner. Therefore, the wire becomes free from a stress, can be prevented from being broken and its reliability can be improved.

INDUSTRIAL APPLICABILITY

The coil device of the present invention is used for a solenoid, a magneto coil or the like to generate a magnetic force or for a detector for detecting the number of revolutions of a distributor type pump or the like to detect a magnetic flux. Thus, the wire is prevented from being bent acutely, becomes free from a stress, and is prevented from being broken. And its reliability is improved.

What is claimed is:

1. A coil device which has a plurality of winding drums on a bobbin with a partition formed between flanges at both ends of the bobbin, wherein:

the partition has a slit through which a wire is passed, and among winding pitches of wire wound on adjacent winding drums with the partition therebetween, at least a pitch between a segment of the wire passing through the slit and its adjacent segment of the wire is larger than a pitch between the segments of the wire at other portions.

* * * * *